US008065936B2

(12) United States Patent
Tutino

(10) Patent No.: US 8,065,936 B2
(45) Date of Patent: Nov. 29, 2011

(54) OFFSET PASS THROUGH DEVICE

(76) Inventor: John C Tutino, Newtown, PA (US)

( * ) Notice: Subject to any disclaimer, the term of this patent is extended or adjusted under 35 U.S.C. 154(b) by 192 days.

(21) Appl. No.: 12/508,769

(22) Filed: Jul. 24, 2009

(65) Prior Publication Data

US 2011/0017023 A1 Jan. 27, 2011

(51) Int. Cl.
*B25B 17/00* (2006.01)

(52) U.S. Cl. ..... 81/57

(58) Field of Classification Search ..... 081/57.3, 081/57.14, 57.13, 57.29, 180.1, 177.2, 57.46
See application file for complete search history.

(56) References Cited

U.S. PATENT DOCUMENTS 87,531 A * 3/1869 Wilcox ..... 81/57.3
1,042,736 A * 10/1912 Wildmo ..... 81/57.3
7,204,174 B1 4/2007 Wood
7,484,438 B2 2/2009 Murphy
7,703,356 B2 * 4/2010 Bass ..... 81/57.3
2008/0135271 A1 * 6/2008 Murphy ..... 81/57.29
2008/0196554 A1 8/2008 Tutino

OTHER PUBLICATIONS

Tutino; John C., U.S. Appl. No. 60/880,769 (Jan. 17, 2007).

* cited by examiner

*Primary Examiner* — Hadi Shakeri

(57) ABSTRACT

A device having a pass through formed therein that is offset from point where energy is received in order to perform a function (e.g., drive, tighten, thread, cut) on a material (e.g., pipe, rod) passing therethrough. The device may include a coupler to connect to an energy source (e.g., drill, impact gun, hand crank), an insert within the pass through to perform the functions, and gears (number and type may vary) to transfer the energy from the coupler to the pass through. The insert may perform the functions or may receive tools to perform the functions. The device may include two substantially similar pass throughs capable of receiving the insert or the coupler so as to provide a configurable device (e.g., torque vs. speed, push vs. pull) The coupler may be rotatable around the perimeter of the device to allow one to work in hard to reach places.

11 Claims, 8 Drawing Sheets

OFFSET PASS THROUGH DEVICE

BACKGROUND

Those who work with tools, whether on a daily basis such as the professional laborer or those who make intermittent use such as the novice, have a desire that the tool they choose to use will be ideally suited for the task with a minimal amount of inconvenience. In some cases it seems that the optimal tool does not exist. One must instead make use of several different tools in the hopes of completing the task.

Anyone who has tried to repair plumbing or work on other types of pipes or rods knows that at times there are not enough hands to complete the task. Plumbing pipe due to the environment in which it is generally located is surrounded by many obstacles (e.g., walls, floors, other pipes, electrical conduit, or structural supports). These obstacles may prevent ease of access or even completely block all access and pose a challenge to the professional or the novice who attempts to work in this environment. Because of these impediments, it may be difficult to orient the chosen tools to accomplish the desired task.

Equally challenging is the situation where one seeks to join threaded rods between the floor and ceiling of a room. One must pull one threaded rod up from the floor while at the same time attaching it to another threaded rod coming through the ceiling. Such a task may require one to use two or more tools simultaneously with outstretched arms or have a friend or coworker assist in holding the one bar in place while the other is raised or lowered into the correct position and fastened.

Moreover, the scenario may be somewhat different, as one may instead need to replace or repair a damaged rod or pipe. For example, one might have over tightened the nut on an overhead rod and damaged it. In this instance to fix the damaged rod one may be required to rethread the damaged rod and install a new nut. In another scenario, one might be required to replace a portion of the overhead rod as it is too badly damaged to reconnect it to the rod coming through the floor. To replace the damaged portion of the rod one may need to make a cut at some point along its length. To make such a cut would likely require two people or multiple tools. In either case whether rethreading or cutting the damaged rod the task may be expensive, as one will need to own several different tools, time consuming, as one is changing from tool to tool to perform the task, or labor intensive as more than one person is likely needed to complete the task.

These are just a few of the examples that one may draw upon to illustrate that there are difficulties that the user of tools encounter whether they are a professional or a novice. What is needed is a tool that will diminish the cumbersomeness of these tasks and more while providing the professional and novice alike with several options in a single tool. Accordingly, the offset pass through device is needed, as it will aid those who engage in such work to better accomplish their desired task with the minimal amount of inconvenience and expenditure on labor or additional tools.

BRIEF DESCRIPTION OF DRAWINGS

The features and advantages of the various embodiments will become apparent from the following detailed description in which.

DETAILED DESCRIPTION

Figure 1:
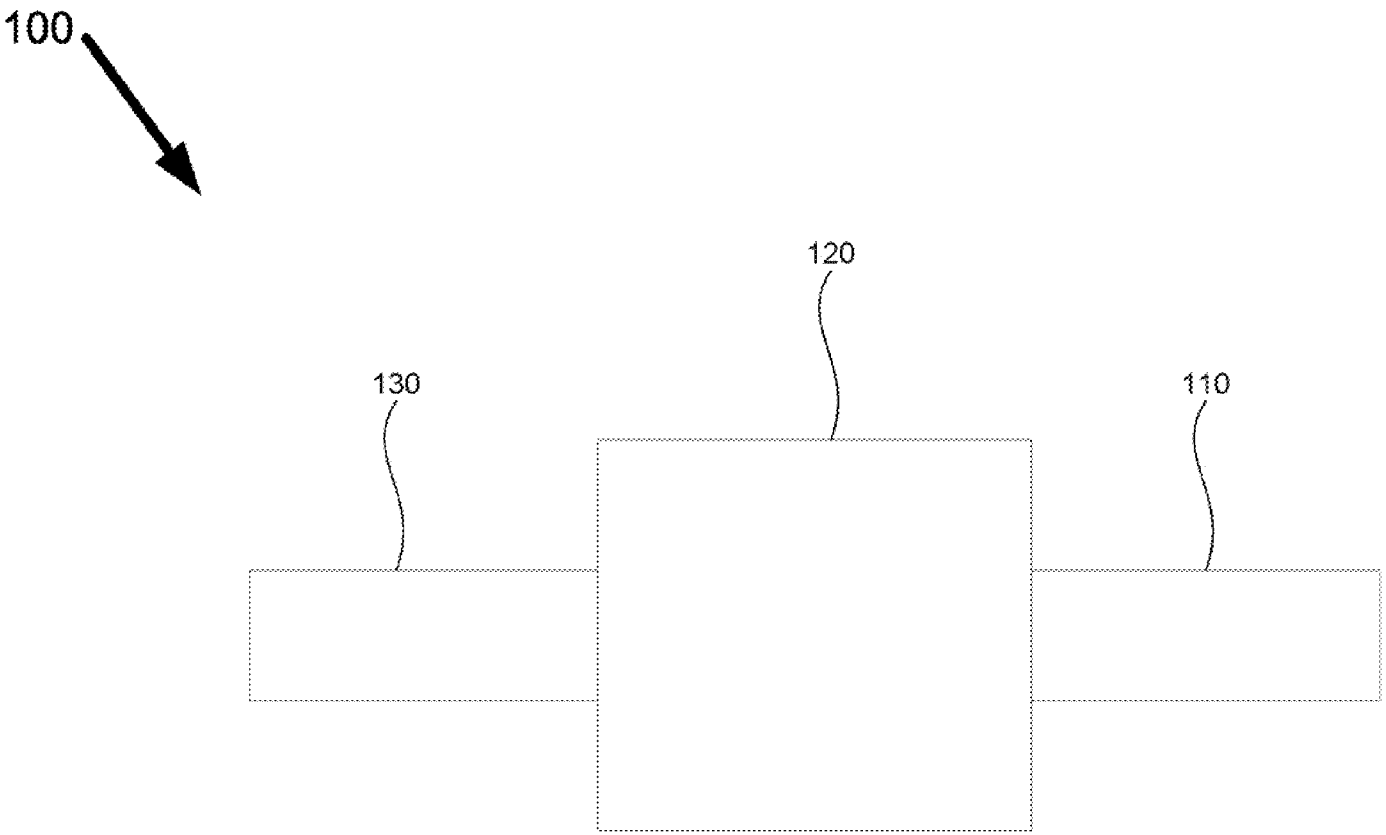
FIG. 1 illustrates a block diagram of an example offset pass through device, according to one embodiment.

FIG. 1 illustrates a block diagram of an example offset pass through device 100. The device 100 may include a pass through portion 110 (simply referred to hereinafter as pass through), an energy transfer member 120 (simply referred to hereinafter as transfer member), and an energy device coupler 130 (simply referred to hereinafter as coupler). The pass through 110 may include at least one opening in the device 100 to enable a material (e.g., rod, shaft, pipe) to pass through the device 100. The pass through 110 may be formed in such a fashion as to be capable of performing an action (e.g., driving a nut, connecting two pipes, threading, cutting) on the material as it passes therethrough. Alternatively, the pass through 110 may be capable of receiving an insert that performs an action on the material as it passes therethrough (the insert having a hole in alignment with the pass through 110 so that material could pass through the insert and the pass through 110). Alternatively, the insert received by the pass through 110 may be capable of receiving any number of tools (e.g., socket, threader, cutter) that can perform an action on the material as it passes therethrough.

The transfer member 120 may transfer energy received by the coupler 130 to the pass through 110 so that the pass through 110 may move along the material. The transfer member 120 may be a system of gears or some other type of energy transferring mechanism. The coupler 130 may receive energy from some external or internal device (e.g., hand crank, drill, impact gun) and may engage in some fashion with the transfer member 120. For example, the coupler 130 may be an insert with an integral attachment, an insert with a removable attachment, a permanently fixed insert, coupling device, or some other member that receives energy from an external or internal energy source and conveys this received energy to the transfer member 120.

Figure 2A:
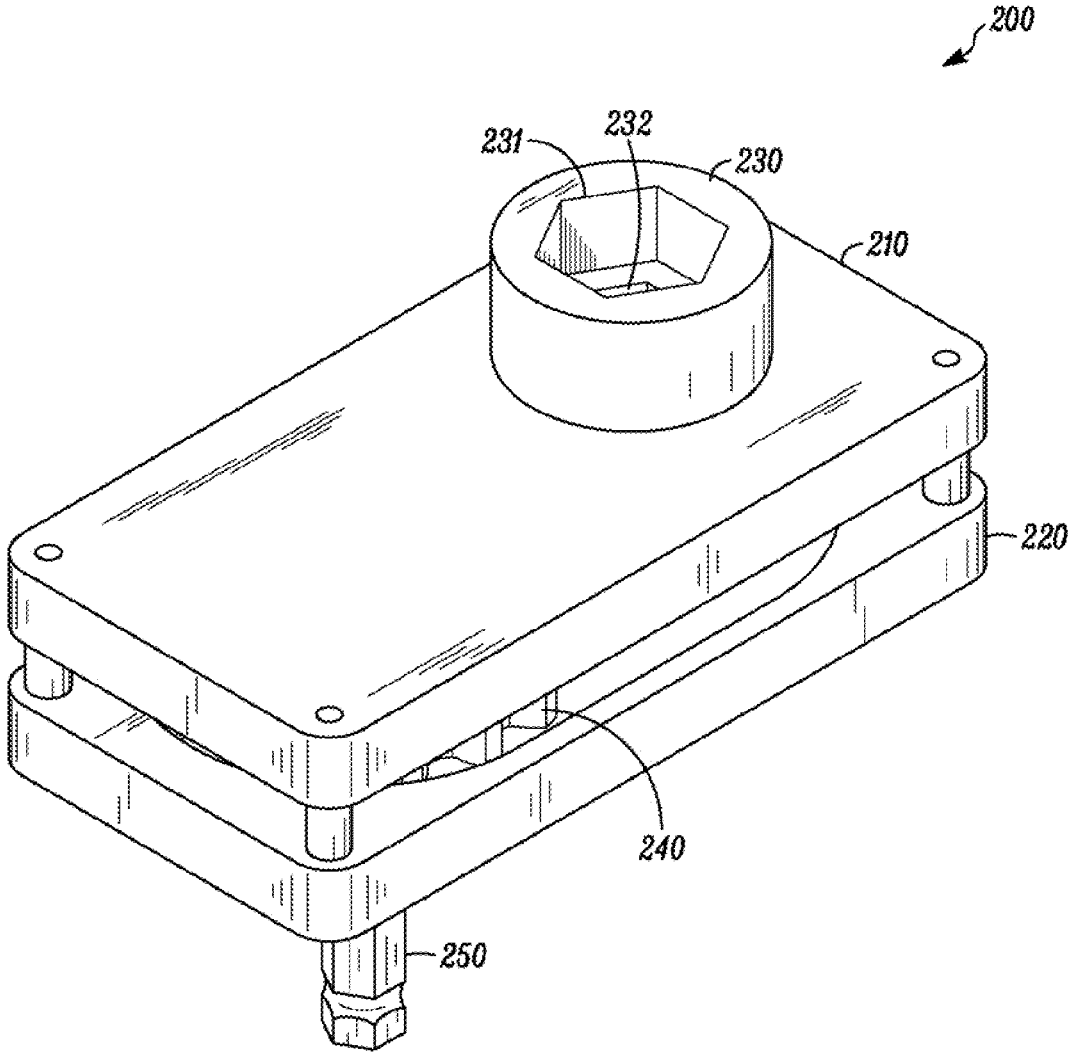
FIG. 2A illustrates a perspective view of an example offset pass through device, according to one embodiment.

FIG. 2A illustrates a perspective view of an example offset pass through device 200 (e.g., 100 of FIG. 1). The device 200 may include a housing (illustrated as a top plate 210 and a bottom plate 220, but not limited thereto), an opening (not visible) passing through the housing, an insert (e.g., socket like insert) 230, an energy transfer member 240 (only partially seen in this view as a portion of a gear), and an energy device coupler (coupler) 250. The insert 230 and the coupler 250 may be parallel (or substantially parallel) to one another. The top plate 210 and the bottom plate 220 may be connected in some fashion (e.g., screws, pins) and may or may not have a spacing therebetween (illustrated with spacing).

The insert 230 may fit within the opening formed in the housing and be secured to the housing. As illustrated, the insert 230 is connected to an opening in the top plate 210 and is located on the top plate 210. The insert 230 may include an opening aligned with the opening in the housing to enable a material to pass through the insert 230 and the housing. The insert 230 may perform a function (e.g., securing a nut, removing a nut, threading, cutting, connecting two pipes) on the material while the material passes therethough. Alternatively, the insert 230 may be capable of receiving any number of tools (e.g., socket, threader, cutter) that can perform an action on the material as it passes therethrough. The opening and the insert 230 (and possibly the tool) may collectively be referred to as a pass through portion of the device (pass through).

The insert 230 may include an outer opening 231 and an inner opening 232 (only partially seen in this view). The inner opening 232 may be in alignment with the hole so as to maintain a hole through the housing for material (e.g., rod, shaft, pipe) to pass. The outer opening 231 may be a socket opening (e.g., hex) to securely hold a nut (e.g., hex type nut) or any other similar type object and enable the nut to traverse (e.g., driven on, removed from) the material while the material passes through the device 200. The insert 230 is illustrated as a hex socket but is not limited to a hex socket but can rather be any type of socket. Furthermore, the insert 230 is not limited to a socket but could be any type of insert (e.g., threader, cutter) that could be used to perform a function (e.g., threading, cutting) on the material while passing the material therethough. Alternatively, the insert 230 may be used to receive tools to perform different functions (e.g., a threader may be inserted within the insert 230). The tools and/or the insert 230 may be magnetized to aid in securing.

The insert 230 may be connected to the transfer member 240 or a portion thereof (e.g., one gear of a multi gear transfer member) in any number of ways including but not limited to welding, pin attachments, screws, press fitting, gluing or any other permanent or temporary means. A temporary connection would enable the insert 230 to be changed based on the application (e.g., size of nut) or be replaced if the insert 230 was cracked or broken. The coupler 250 may be connected to the bottom plate 220 on the opposite side of the insert 230. The coupler 250 may also be connected to the transfer member 240 or a portion thereof (e.g., a different gear of a multi gear transfer member) through any of a number of permanent or temporary means (e.g., welding, pins, screws, press fitting, gluing). The coupler 250 may be a shaft or shank that is connectable to an energy source (e.g., drill, impact gun, hand crank). A temporary connection would enable the coupler 250 to be changed based on the energy source (e.g., size of shaft receiving means) or be replaced if the coupler 250 was cracked or broken.

As illustrated with the coupler 250 and the insert 230 on opposite sides of the device 200, the device 200 will be pushed in a direction away from a user to forward traverse the device 200 on the material (e.g., drive a nut) and will be pulled toward the user to reverse traverse the device 200 (e.g., remove a nut). That is, the device 200 operates in a push mode. According to an alternative embodiment, the coupler 250 and the insert 230 may be connected to same side of device 200 (e.g., on top). The alternative embodiment operates in a pull mode where the device 200 will be pulled in a direction toward the user to forward traverse the device 200 on the material (e.g., drive a nut) and will be pushed away from the user to reverse traverse the device 200 (e.g., remove a nut).

The transfer member 240 may be an arrangement of gears that transfers energy from the energy source to the insert 230. An arrangement of an even number (e.g., 2) of gears will result in the insert 230 turning the opposite way as the energy source while an arrangement of an odd number (e.g., 3) of gears will result in the insert 230 turning the same way as the energy source. The insert 230 may be driven in a clockwise or counter clockwise direction depending upon the requirements of the task to be performed. For example, in a two-gear configuration the coupler 250 may be driven clockwise (forward) to drive the insert 230 counter-clockwise (in reverse) to either forward traverse the material having a left-handed (reverse) connection or reverse traverse the material having a right-handed connection. Conversely, in a two-gear configuration the coupler 250 may be driven counter-clockwise to drive the insert 230 clockwise. In a three-gear configuration the coupler 250 may be driven clockwise to drive the insert 230 clockwise and vice-versa.

The device 200 may also include friction reducing mechanisms (not illustrated) such as bearings or similar devices utilized to minimize the friction created through movements of certain parts of the device 200.

Figure 2B:
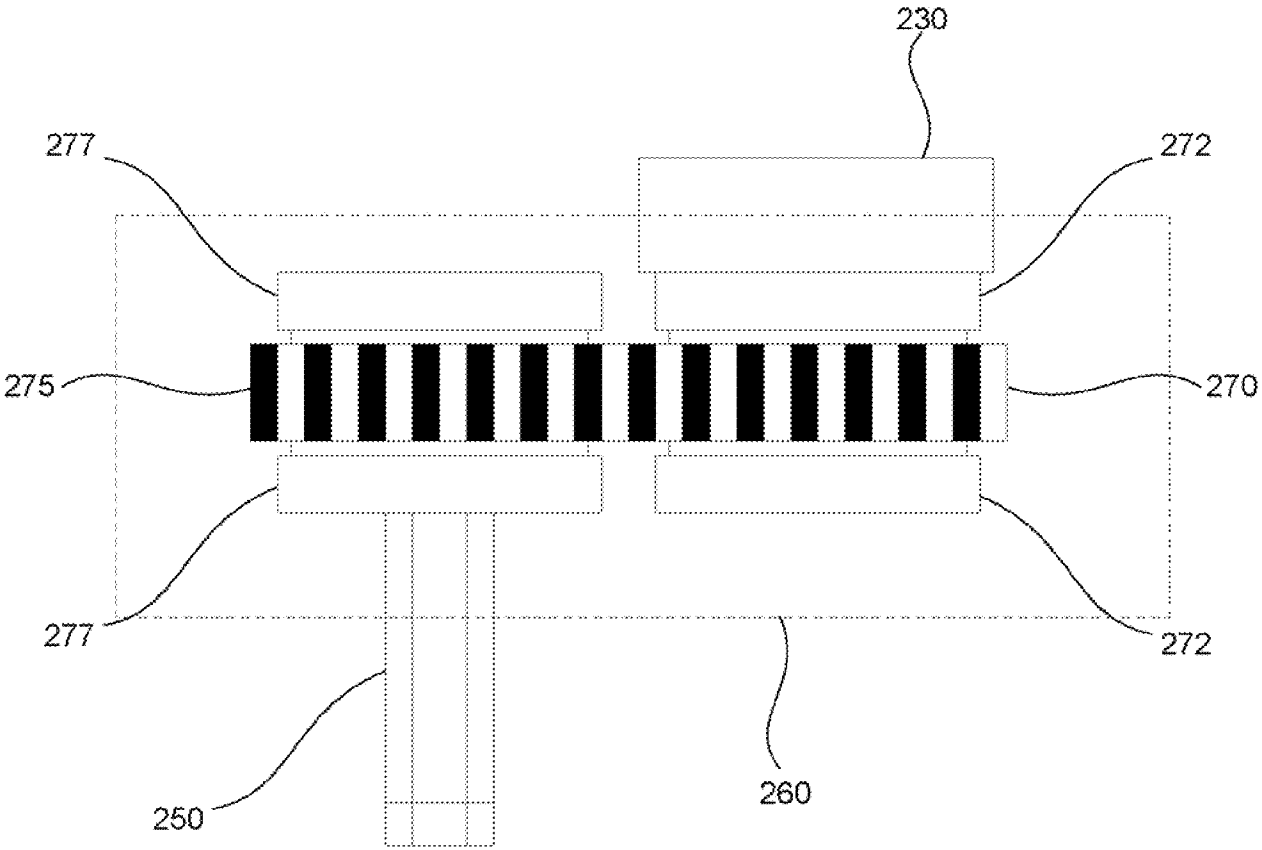
FIG. 2B illustrates a side view of an example two-gear transfer member, according to one embodiment.

FIG. 2B illustrates a side view of an example two-gear transfer member 260 (e.g., 120 of FIG. 1, 240 of FIG. 2A). The transfer member 260 may include two gears 270, 275 with a first gear 270 being associated with the insert 230 and a second gear 275 associated with the coupler 250 The first gear 270 includes an opening (not illustrated) in alignment with the hole in the housing to maintain the pass-through so that the material may pass therethrough. The gears 270, 275 may be configured with a plurality of ratios, varying gear faces, and mesh characteristics. The ratios between the gears 270, 275 may provide additional speed and/or additional torque (e.g., ratio>1 equal more speed, ratio<1 equal more torque). According to one embodiment, the gears 270, 275 may be interchangeable depending upon the application.

The member 260 may also include bearings 272, 277 located on top and/or bottom of the gears 270, 275 respectively. The bearings 272, 277 aid in the rotation of the gears 270, 275. The bearings 272, 277 may be secured to the gears 270, 275 respectively in a permanent or removable means, including but not limited to, pins, welding, glue, and thread. The insert 230 may be coupled permanently or removably to some combination of the gear 270 and the bearings 272. Likewise, the coupler 250 may be coupled permanently or removably to some combination of the gear 275 and the bearings 277.

As noted above, the transfer member 260 drives the insert 230 in the opposite direction as the coupler 250 and energy device. The direction (clock-wise, counter-clockwise) the insert is driven is selected based upon the application for which the member 260 is being used.

Figure 2C:
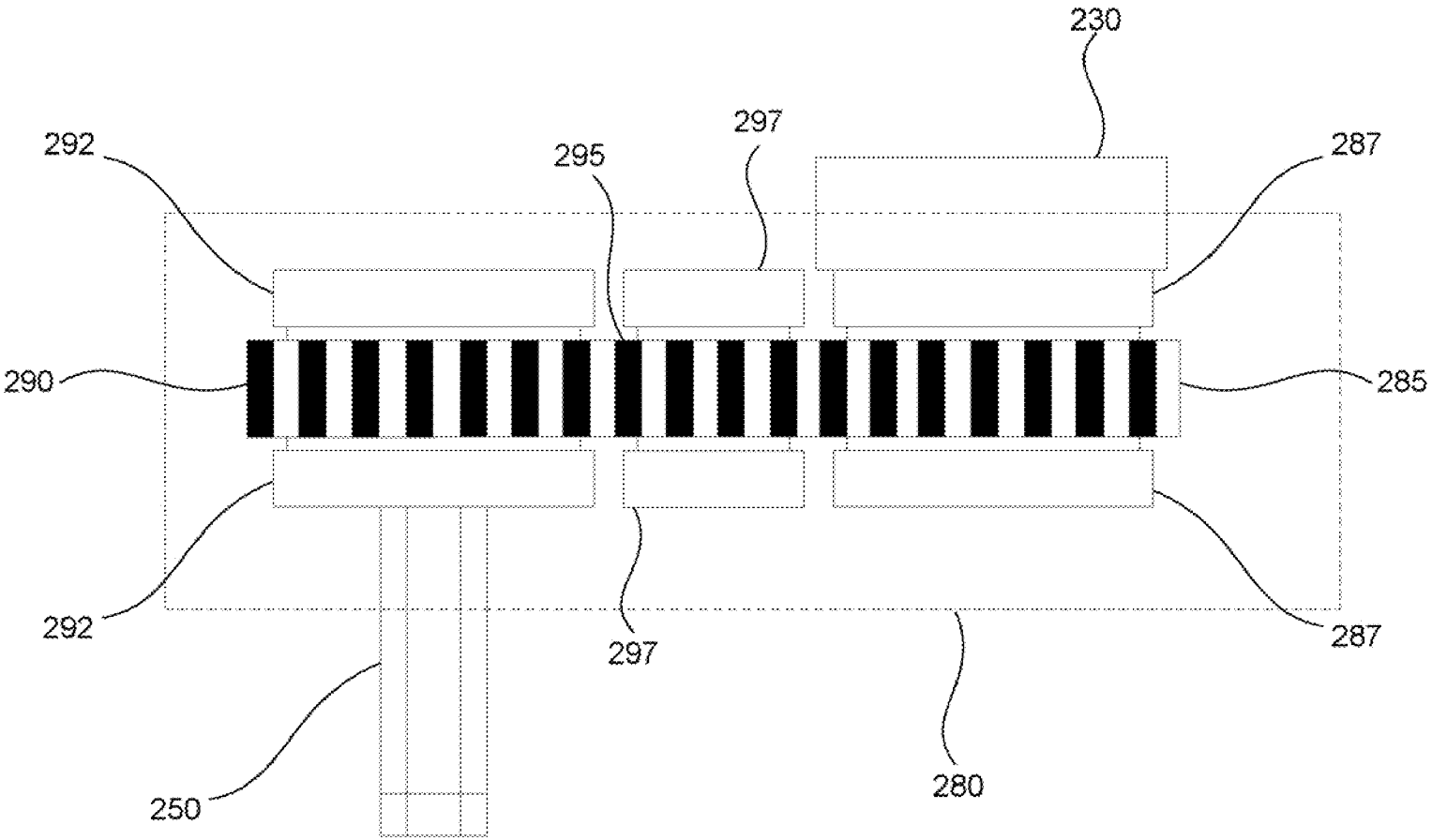
FIG. 2C illustrates a side view of an example three-gear transfer member, according to one embodiment.

FIG. 2C illustrates a side view of an example three-gear transfer member 280 (e.g., 120, 240). The transfer member 280 may include three gears 285, 290, 295 with a first gear 285 being associated with the insert 230, a second gear 290 associated with the coupler 250, and a third gear 295 acting as an idler to change the direction of rotation so that the first and second gears 285, 290 rotate in the same direction. The first gear 285 includes an opening (not illustrated) in alignment with the hole in the housing to maintain the pass-through so that the material may pass therethrough. The gears 285, 290, 295 may be configured with a plurality of ratios, varying gear faces, and mesh characteristics. The ratios between the gears 285, 290 may provide additional speed and/or additional torque (e.g., ratio>1 equal more speed, ratio<1 equal more torque). According to one embodiment, the gears 285, 290, 295 may be interchangeable depending upon the application.

The member 280 may also include bearings 287, 292, and 297 located on top and/or bottom of the respective gears 285, 290, 295 to aid in the rotation thereof. The bearings 287, 292, 297 may be secured to the gears 285, 290, 295 respectively in a permanent or removable means, including but not limited to, pins, welding, glue, and thread. The insert 230 may be coupled permanently or removably to some combination of the gear 285 and the bearings 287. Likewise, the coupler 250 may be coupled permanently or removably to some combination of the gear 290 and the bearings 292.

As noted above, the transfer member 280 drives the insert 230 in the same direction as the coupler 250 and energy device. The direction (clock-wise, counter-clockwise) is selected based upon the application for which the member 280 is being used.

Figure 3A:
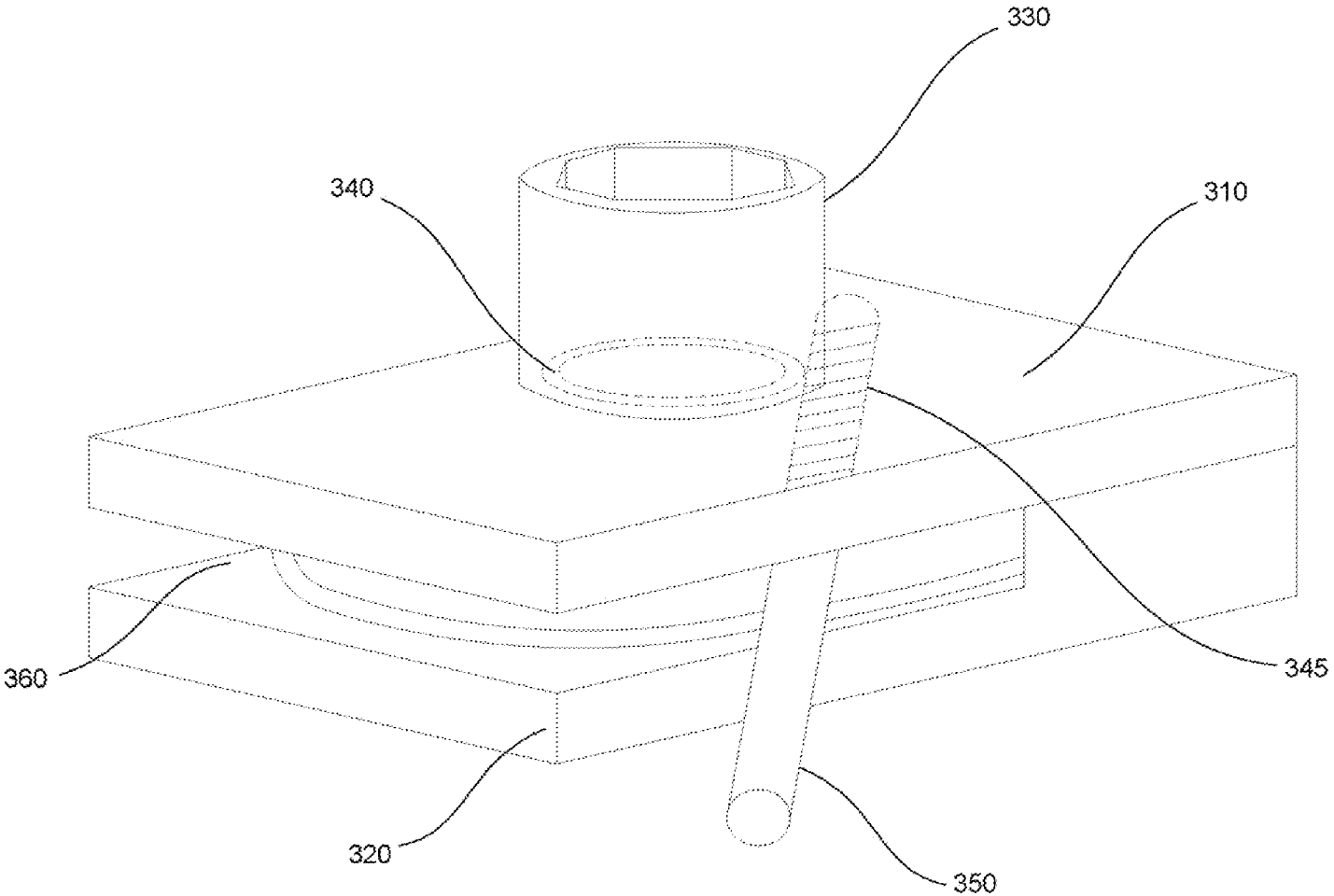
FIG. 3A illustrates a perspective view of an example offset pass through device, according to one embodiment.

FIG. 3A illustrates a perspective view of an example offset pass through device 300. The device 300 may include a housing (illustrated as a top plate 310 and a bottom plate 320), a hole (not visible) passing through the housing, an insert (e.g., socket like insert) 330, an energy transfer member (not illustrated separately), and an energy device coupler (coupler) 350. The top plate 310 and the bottom plate 320 may be connected in some fashion (e.g., screws, pins) and may or may not have a spacing therebetween (illustrated with spacing in forward section). A channel 360 may be formed in the housing (in top plate 310, bottom plate 320, or spacing therebetween). The channel 360 is to receive the energy device coupler 350 so the coupler 350 is perpendicular (or substantially perpendicular) to the insert 330. The channel 360 may enable the coupler 350 to rotate around the periphery of the housing so that one may use of the device 300 in hard to reach spaces. For example, if the coupler 350 is angled on the right side (as illustrated) it will enable the device 300 to be used where the hard to reach space is to the left, if the coupler 350 is angled on the left side it will enable the device 300 to be used where the hard to reach space is to the right, and is the coupler 350 comes straight (or substantially straight) from the front surface (where channel 360 is illustrated) it will enable the device 300 to be used where the space below the device 300 is limited.

The housing may include some means for holding (not illustrated) the coupler 350 in place at a plurality of different locations within the channel 360. The holding means may include grooves, latches, pins, screws, locks or other mean for securing the coupler 350 in place. The channel 360 may include a bearing, bushing, or other means to assist in the rotation. According to an alternative embodiment, the device 300 may not include a channel 360 but may rather include one or more openings with which the coupler 350 may be connected along the side thereof and communicate with the energy transfer member. Alternatively, the coupler 350 may be fixed at a given location along a side thereof. In the fixed location embodiment, if the hole in the housing was configured to receive the insert 330 on either end, the device 300 could be used for tight spaces on the right or left by switching the side the insert 330 was connected to and flipping the device 300 over.

The transfer member may include a gear system that enables the gears to stay in communication with one another and provide the transfer of energy from the coupler 350 to the insert 330 as the coupler 350 is rotated around the periphery of the device 300. The transfer member may include a first gear 340 (illustrated as dotted line to indicate it is within the housing) that is coupled to the insert 330 and stays at a fixed location within the housing (has a fixed axis of rotation). The transfer member may also include a second gear 345 (illustrated as dotted line to indicate it is within the housing) that is connected to or formed in the coupler 350. The second gear 345 may be separate and detachable from the coupler 350 or it may be permanent and a part of the coupler 350. For example, the second gear 345 may be attached to the coupler 350 through welding, gluing, press fitting, threading, or any other similar temporary or permanent means of attachment. The second gear 345 may be cast, drawn, machined or manufactured in any other way as to make it a part of the coupler 350.

When the coupler 350 is rotated, the second gear 345 is rotated which also causes the first gear 340 to rotate around the fixed axis. The second gear 345 may engage the first gear 340 and cause the first gear 340 to spin as the second gear 345 spins (transfer energy). The transfer of energy from the coupler 350 to the insert 330 enables the insert 330 to perform an operation (e.g., drive/remove nut, cut, thread) on a material (e.g., rod, shaft, pipe) as the material passes through the hole and the insert 330.

As illustrated the transfer member is a worm gear system that includes a worm or worm drive 345 and a worm wheel or worm gear 340. The worm gear system may be configured with a plurality of ratios, varying gear faces, and mesh characteristics. The transfer member is not limited to a worm gear system but can be other gear systems (beveled gears) or other systems that enable to transfer energy in such a configuration.

The insert 330 is illustrated as a hex socket but is not limited to a hex socket but can rather be any type of socket. Furthermore, the insert 330 is not limited to a socket but could be any type of insert that could be used to perform a function on the material while passing the material therethough. Alternatively, the insert 330 may be used to receive tools to perform different functions on the material. The insert 330 may be connected with the first gear 340 in a permanent or temporary manner.

Figure 3C:
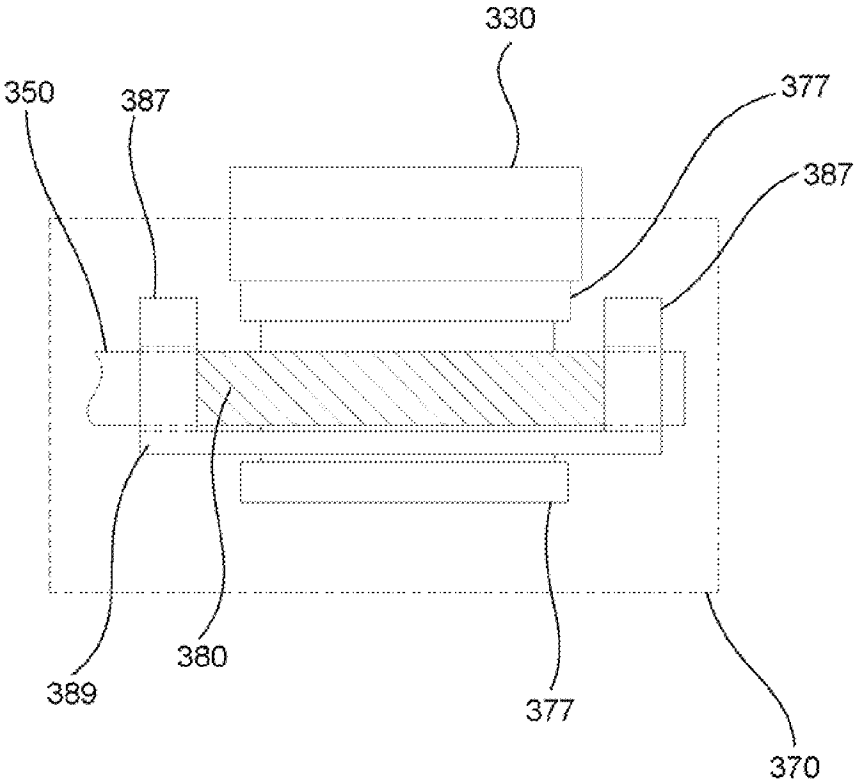
FIG. 3C illustrates a right side view of the example transfer member of FIG. 3B, according to one embodiment.
Figure 3B:
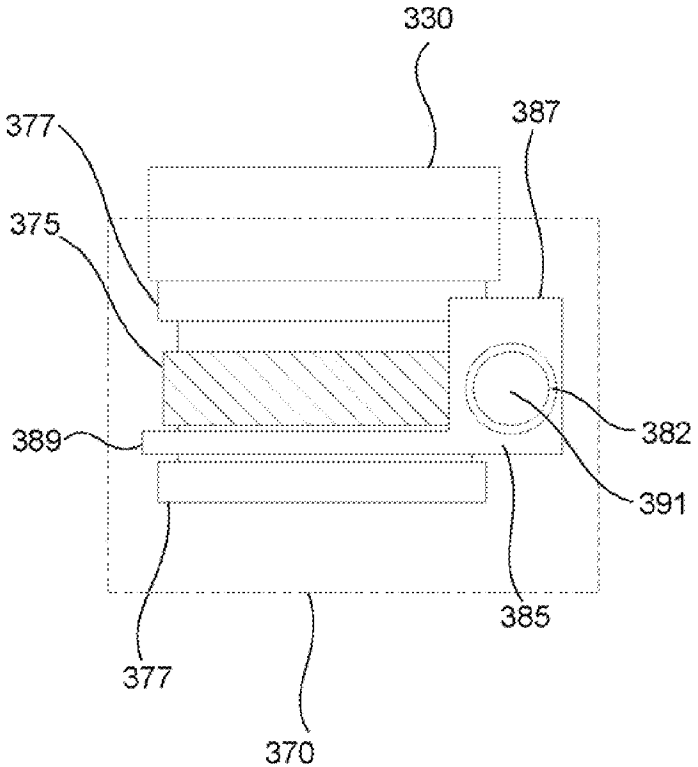
FIG. 3B illustrates a front view of an example transfer member, according to one embodiment.

FIG. 3B illustrates a front view of an example transfer member 370 (e.g., 340, 345 of FIG. 3A). The transfer member 370 may include a first gear 375 (e.g., 340 of FIG. 3A) secured at a fixed point of rotation within the housing, a second gear (not visible in this view; e.g., 345 of FIG. 3A) rotatable with respect to the periphery of the housing, and a rotatable cradle 385 to receive the second gear, and secure the first gear 375 and the second gear in communication with one another as they are rotated with respect to the periphery of the housing. The second gear may be connected to the coupler (not visible in this view; e.g., 350 of FIG. 3A) or may be part of the coupler. The rotatable cradle 385 may include a cradle 387 to receive and support the second gear (and coupler) and a base 389 in communication with the first gear 375. The base 389 may provide support for the cradle 387 and may be used rotate the first gear 375 around the fixed axis of rotation as the coupler and the second gear are rotated around the periphery of the housing.

The cradle 387 may include one or more sidewalls having openings 391 formed therein wherein the second gear passes through the openings 391 and rests therein. The openings 391 may include bearings 382 therein to support the rotation of the second gear within the openings 391. The base 389 may be in communication with the first gear 375 (e.g., below the teeth in the gear). A bearing (not visible in this view) may be included between the base 389 and the first gear 375 to support rotation of the first gear 375. The base 389 may be secured to the bearing in a temporary or permanent manner.

The first gear 375 may have bearings 377 connected (permanently or temporarily) thereto to aid in the rotation thereof. The insert 330 may be coupled permanently or removably to some combination of the first gear 375 and the bearings 377.

FIG. 3C illustrates a right side view of the example transfer member 370. The second gear 380 is secured within openings (not visible in this view) of two sidewalls of the cradle 387. The base 389 may be in communication a bearing (not visible) in communication with the first gear 375 below the teeth (teeth not visible in this view). The first gear 375 may have bearings 377 connected thereto to aid in the rotation thereof. The insert 330 may be coupled to some combination of the first gear 375 and the bearings 377.

Figure 3D:
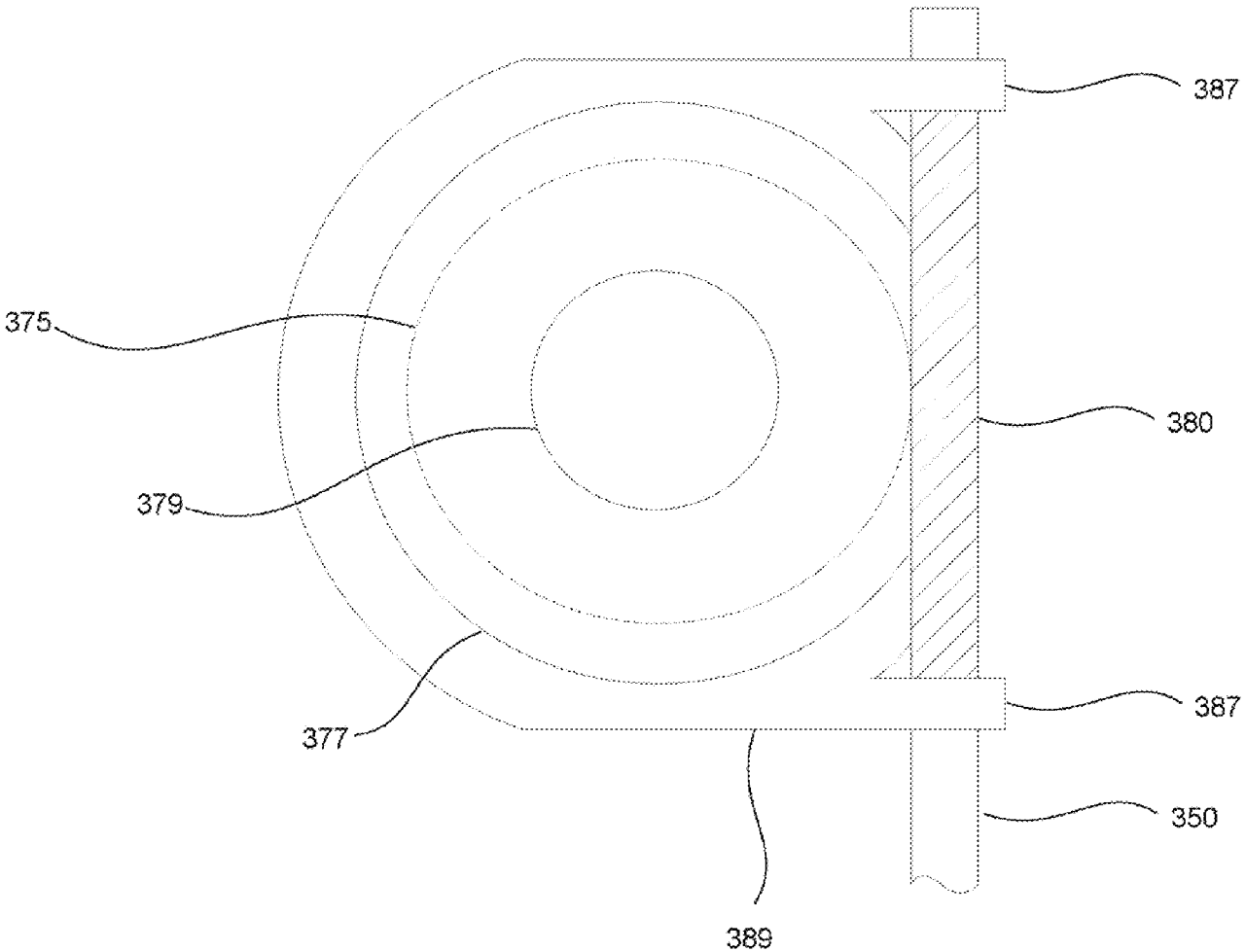
FIG. 3D illustrates a top view of the example transfer member of FIG. 3B, according to one embodiment.

FIG. 3D illustrates a top view of the example transfer member 390. The second gear 380 integrated with the coupler 350 is secured within openings (not visible in this view) of two sidewalls of the cradle 387. The base 389 may be in communication with a bearing 377 in communication with the first gear 375 and may provide support to the cradle 387. The first gear 375 may have a hole 379 formed therein in alignment with the hole in the housing, the hole in the insert, and a hole in the bearings 377, the aligned holes forming a pass through.

Figure 4:
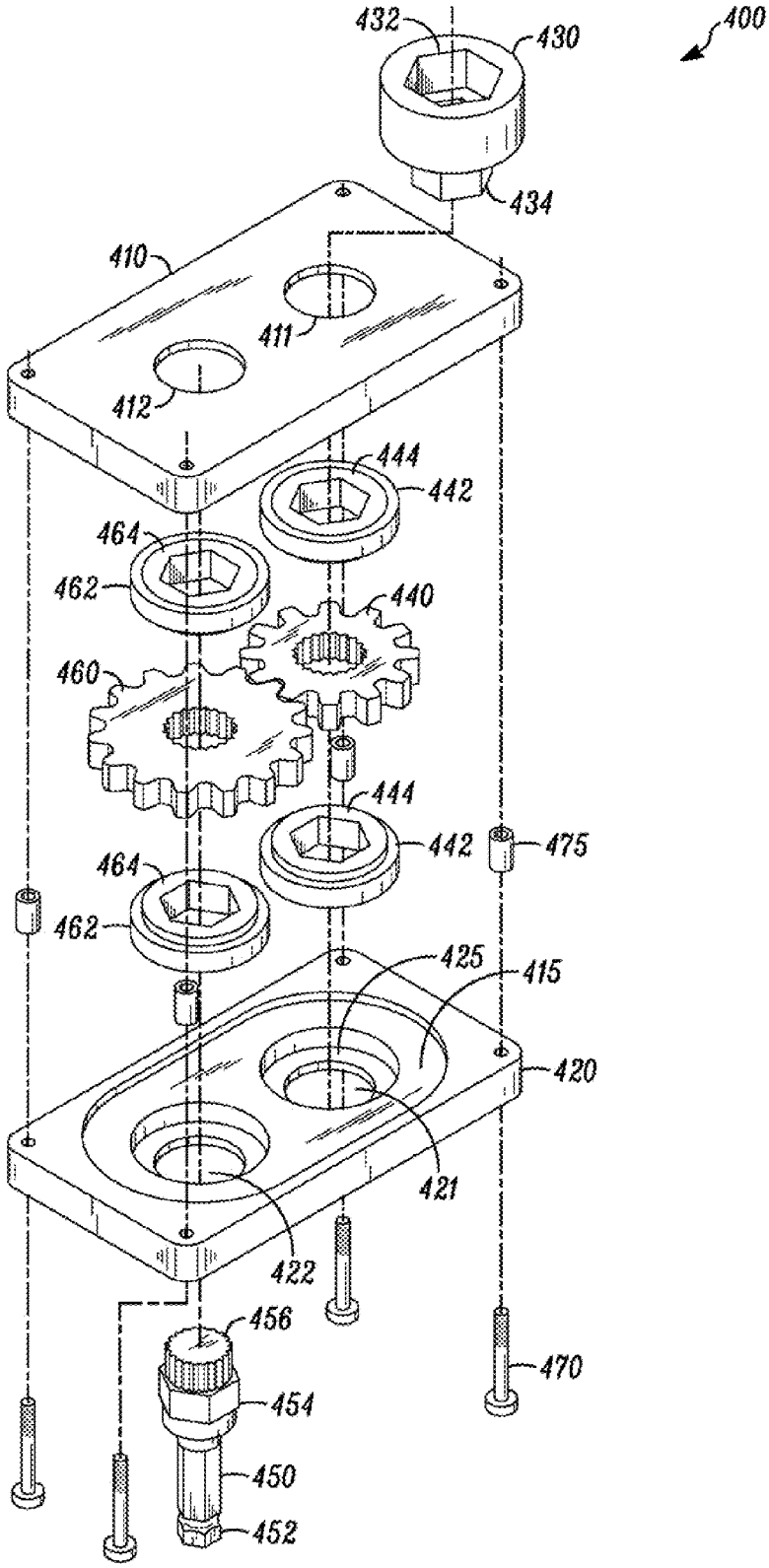
FIG. 4 illustrates an exploded view of an example configurable offset pass through device, according to one embodiment.

FIG. 4 illustrates an exploded view of an example configurable offset pass through device 400. The device 400 may be substantially symmetrical (from right to left and/or top to bottom) in order to enable the device 400 to be configurable. The device 400 may include a housing that has a top plate 410 and a bottom plate 420 that are connected in some fashion and may or may not have an opening between them. For example, a multitude of fastening devices 470 (e.g., screws) may be used to secure the top plate 410 to the bottom plate 420. Spacer like devices 475 may be utilized between the plates 410, 420 to provide spacing therebetween. The top and bottom plates 410, 420 may have a plurality (e.g., 2) of openings 411, 412; 421, and 422 formed therein. When the plates 410, 420 are connected the holes 411, 421 and 412, 422 will align to form two passthroughs (not separately illustrated) in the connector 400.

The device 400 may include a transfer member (not separately illustrated) to transfer energy received from one pass through to the other pass through. The transfer member may include a plurality of gears (e.g., 2) with one gear 440 associated with a first pass through (411, 421) and a second gear 460 associated with a second pass through (412, 422). The gears 440, 460 may include openings therein that are aligned with the pass throughs 411/421, 412/422 to enable material to pass therethrough. The gears 440, 460 may communicate with one another so energy received by one is transferred to the other. Either gear 440, 460 may receive energy from an energy device via an energy device coupler 450 and either gear 460, 440 may transfer the energy to perform an operation on a material passing therethrough via an insert 430.

The gears 440, 460 are not restricted to a particular ratio, gear face, or mesh characteristic. According to one embodiment, the gears 440, 460 and may be removed and reconfigured as the application requires. Furthermore, the device 400 is not limited to two gears 440, 460 as illustrated. Rather any number of gears can be used as long as each pass through 411/421, 412/422 has a gear associated therewith that has a hole formed therein in alignment with the pass through. For example, the device 400 could have an odd number (e.g., 3) of gears so that the energy transferred from one through hole to the other through hole is in the same direction.

The device 400 may include bearings 442, 462 located on top and bottom of the respective gears 440, 460 to aid in rotation of the gears 440, 460. A connector 444, 464 may be located within each respective bearing 442, 462. The connectors 444, 464 may be utilized to secure the insert 430 and/or the coupler 450 within the appropriate pass through 411/421, 412/422. The connectors 444, 464 may have an opening that is bigger than the opening in the gears 440, 460 to enable the connectors 444, 464 to secure to the insert 430 and still provide an opening with which a material may pass through. The opening in the connectors 444, 464 is illustrated as being hex shaped but is not limited thereto. Rather, the opening in the connectors 444, 464 can be any shape or configuration that can be used to secure the insert 430 or the coupler 450 thereto. The openings in the plates, the connectors, and the gears that are in alignment with one another form the pass throughs in the device 400.

The connectors 444, 464 and the bearings 442, 462 may be permanently or temporarily secured to one another. The connectors 444, 464 and the bearings 442, 462 may be permanently or temporarily secured to the respective gears 440, 460 by, for example, welding, pins, gluing, or set screws.

The plates 410, 420 may have recessed areas 425 (only visible for the bottom plate 420) formed on their interior surfaces around the openings 411, 412, 421, 422. The recessed areas 425 may enable the bearings and connectors 442/444, 462/464 to sit therewithin. The plates 410, 420 may have an additional recessed areas 415 (only visible for the bottom plate 420) formed around the recessed areas 425 to enable the gears 440, 460 to sit at least partially therewith.

The insert 430 may have an inner opening that will be aligned with the pass through (e.g., holes in the plates, connectors, and gears) and an outer opening 432 that is used to perform an operation on a material as it passes therethough. The outer opening 432 may perform the operation or may be capable of receiving a tool that will perform the operation. For example, the outer opening 432 may be shaped (e.g., hexed) to be capable of driving a nut or may be capable of receiving a tool having an outer edge shaped and sized to be received thereby. The insert 430 may have a male part 434 that when inserted into the opening 411 (as illustrated) in the device 400 will connect in some fashion to the applicable connector 464 (as illustrated). As illustrated the male part 434 is hexed shaped and connects to the hexed shaped connector 464. The male part 434 may extend further and connect to the gear 460 and possibly the connector 464 below the gear 460.

The coupler 450 may include a shaft or shank 452 to be connected to and driven by an energy device (e.g., drill, impact gun, air ratchet, manual crank) that is either external or internal to the device 400. The coupler 450 may include a head 454 that is connected to the shaft 452 for connecting to the device 400. When inserted in the opening 422 (as illustrated) the head 454 may connect in some fashion to the applicable connector 444 (as illustrated). As illustrated the head 454 is hexed shaped and connects to the hexed shaped connector 444. The head 454 may extend further and connect to the gear 440 and possibly the connector 444 above the gear 440. The head 454 may include a geared portion 456 and the opening within the gear 440 may be geared so that the connection therebetween provides additional support to the coupler 450. The additional support may be desired as the coupler 450 is receiving the energy. To provide additional support to the coupler 450, a connector (not illustrated) may be inserted into the other end of the pass through from the coupler and may engage with the head 454 (or the geared portion 456) within the device 400 to secure the coupler 450 within the device 400.

The device 400 enables the coupler 450 and the insert 430 to be connected to and secured within any one of the openings 411, 412, 421, 422. As illustrated, the coupler 450 is connected to the lower left opening 422 and the insert 430 is connected to the upper right opening 411, but is not limited thereto. The only constraint on the locations of the insert 430 and the coupler 450 is that the device 400 must still have a pass through that is offset from where the energy is received (e.g., the insert 430 and the coupler 450 are not connected to the same pass through).

The configurable aspect of the device 400 enables the energy transfer ratios of the device (e.g., switch from providing additional torque to providing additional speed) to be switched by switching the sides of the device that the coupler 450 and insert 430 are connected thereto. That is, to provide additional torque the coupler 450 would be connected to the gear having less teeth and the insert 430 would be connected to the gear having more teeth. Conversely, to provide additional speed the coupler 450 would be connected to the gear having more teeth and the insert 430 would be connected to the gear having fewer teeth. The configurable aspect of the device 400 also enables the device 400 to either be operated in a push or pull configuration. For example, if the coupler 450 and the insert 430 are on the same side of the device 400 they will operate in a pull fashion and if on opposite sides will operate in a push fashion.

Although the various embodiments have been illustrated by reference to specific embodiments, it will be apparent that various changes and modifications may be made. Reference to "one embodiment" or "an embodiment" means that a particular feature, structure or characteristic described in connection with the embodiment is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed is:

1. A device comprising:

a housing having a first and a second through hole formed therein, wherein each through hole has an opening on a first side of the housing and an opening on the second side of the housing, wherein the openings for each of the through holes is substantially the same;

an energy device coupler, adapted to be received by the first side or the second side of one of the through holes, to receive energy from a driving device;

an insert, adapted to be received by the first side or the second side of other of the through holes and including an inner opening therein in alignment with the other of the through holes to enable a material to pass therethrough, to perform an operation on the material as it passes therethrough;

a transfer mechanism to transfer energy received from the energy device coupler to the insert, wherein the transfer mechanism includes a first gear associated with a first through hole and a second gear associated with a second through hole, wherein first gear has different number of teeth then the second gear, wherein said substantially the same openings enables interchangeable engagement of the energy device coupler and the insert, thereby the ratio of teeth in the first gear to teeth in the second gear controls different speed and torque of transferred energy depending on the openings operably engaged by the energy device coupler and the insert.

2. The device of claim 1, wherein the insert includes a socket, wherein the material is a threaded material, and wherein the operation is to traverse a nut on the threaded material.

3. The device of claim 1, wherein the insert includes a threader, and wherein the operation is to thread the material.

4. The device of claim 1, wherein the insert includes a cutter, and wherein the operation is to cut the material at some point as it passes therethrough.

5. The device of claim 1, wherein the transfer mechanism includes an even number of gears.

6. The device of claim 1, wherein the transfer mechanism includes an odd number of gears.

7. The device of claim 1, wherein the driving drive is selected from a group including a drill, an impact gun, and a hand crank.

8. The device of claim 1, wherein first gear has less teeth then the second gear and wherein if the energy device coupler is received by the first through hole the transfer mechanism will transfer the energy received at a higher torque; and if the energy device coupler is received by the second through hole the transfer mechanism will transfer the energy received at a higher speed.

9. The device of claim 1, wherein the energy device coupler is received by the first side of the first through hole and wherein if the insert is received by the first side of the second through hole the operation will be a pull operation; and if the insert is received by the second side of the second through hole the operation will be a push operation.

10. The device of claim 1, wherein the insert is to drive, cut, tighten, or thread the material.

11. The device of claim 1, wherein the insert is to receive a tool to perform the operation on the material.

* * * * *